US005586691A

United States Patent [19]

Gotch et al.

[11] Patent Number: 5,586,691

[45] Date of Patent: Dec. 24, 1996

[54] COMBINATION DISPENSE TAP AND CUSTOMER INFORMATION DISPLAY

[75] Inventors: Henry E. Gotch, Sunbury-on-Thames; Roger J. Hyde, Little Harrowden, both of England

[73] Assignee: Alumasc Limited, Kettering, England

[21] Appl. No.: 381,953

[22] PCT Filed: Aug. 11, 1993

[86] PCT No.: PCT/GB93/01701

§ 371 Date: Apr. 17, 1995

§ 102(e) Date: Apr. 17, 1995

[87] PCT Pub. No.: WO94/04456

PCT Pub. Date: Mar. 3, 1994

[30] Foreign Application Priority Data

Aug. 14, 1992 [GB] United Kingdom ..... 9217293
Oct. 15, 1992 [GB] United Kingdom ..... 9221677

[51] Int. Cl.[6] ..... B65D 5/66

[52] U.S. Cl. ..... 222/113; 222/192; 362/399; 40/332

[58] Field of Search ..... 222/113, 192; 362/399; 40/332

[56] References Cited

U.S. PATENT DOCUMENTS 2,295,468 9/1942 Haley .
2,631,393 3/1953 Hetherington ..... 222/113 X
3,286,385 11/1966 Tate, Jr. ..... 40/332 X
3,321,861 5/1967 Tate, Jr. ..... 40/332
4,226,343 10/1980 Fling .
4,493,443 1/1985 Bailey .
4,736,890 4/1988 Wallington .
4,894,647 1/1990 Walden .

FOREIGN PATENT DOCUMENTS 2005451 4/1979 United Kingdom .
2199806 7/1988 United Kingdom .
2222815 3/1990 United Kingdom .

*Primary Examiner*—Gregory L. Huson
*Attorney, Agent, or Firm*—William R. Hinds

[57] ABSTRACT

Customer information display apparatus is attached to a beverage dispense tap. In one embodiment the dispense tap handle 18 is formed of or includes light transparent and/or light reflective material, a light generating means 22, 30 is attached to the tap body, or a counter fitting therefor, remote from the tap handle, and means 36, 20 are provided to direct light from the light generating means to the tap handle, whereby, in use, the tap handle can illuminate to display customer information. In another embodiment, a shield 58 is provided on the tap body 10 and/or the tap handle 40 to present an information display surface to face customers and to mask from customer view the pivotal interface 12 between the tap handle and the tap body, at least when the tap handle is in its closed position. The apparatus may be designed for attachment to existing taps with minimal or no modification.

12 Claims, 4 Drawing Sheets

COMBINATION DISPENSE TAP AND CUSTOMER INFORMATION DISPLAY

This invention relates to dispense taps for beverages and other fluids and particularly relates to customer information displays for such dispense taps.

Taps for pressure-fed beer dispense systems are conventionally attached to a bar counter by a so-called counter fitting that comprises a bracket mounted under or clamped to a bar counter and to which the shank of a dispense tap is attached. Such dispense taps have a tap handle pivoted to a tap body and arranged to open and close a valve in the tap body as the tap handle is operated between an open and a closed position. Typically an attractive display, a counter mount, is fitted to the top of the bar counter; to hide the dispense tap and advertise the beer available from that tap, on the like customer information. The counter mount is often illuminated, conventionally by a 12 or 24 volt festoon lamp; supplied by a mains transformer, provided under the counter.

It is known to illuminate the handle of a dispense tap, see for example, U.S. Pat. Nos. 2,295,468, 2,631,393, 3,286, 385, 3,321,861 and 4,894,647; in each case the light generating means, an incandescent light bulb, is contained within the tap handle. This raises problems of supplying electric power to the light bulb, of overheating the handle, of safety and requires a specially designed dispense tap; i.e. it is not possible to retrofit or convert existing dispense taps to have an illuminated handle.

It is one object of the present invention to provide a combination of customer information display apparatus and dispense tap wherein the tap handle is illuminated in such manner as to overcome the above-stated problems.

According to the present invention, customer information display apparatus in combination with a dispense tap, for beverages and other fluids, and wherein the dispense tap has a tap body, for attachment to a counter fitting, and an operating lever assembly with an illuminated tap handle, connected to a tap opening and closing mechanism in the tap body, the operating lever assembly includes a tap handle formed at least in part of light transparent and/or light reflective material and a tap handle holder connected to the tap opening and closing mechanism; and, the display apparatus includes a light generator mounted externally to the tap handle, and means to direct light from the light generator into or onto the tap handle; whereby, in use, the tap handle can be illuminated to display customer information. Thus, by the present invention, light is directed from an external source into or onto the handle and this obviates the above-given disadvantages of known illuminated tap handles. Also, the present invention provides a neat, attractive dispense tap that does not need a large, cumbersome counter mount for a customer information display; this further has the advantage that counter space, which is often at a premium can be saved and dispense taps mounted closer to one another behind to counter.

According to one embodiment of the present invention, the tap handle is formed at least in part of light transparent material and the light director means are arranged to direct light from the light generator into the interior of the tap handle. Thus the tap handle will appear to glow by virtue of internal transmission of light through the handle and back-printed or etched designs on the handle will generate eye-catching displays.

In another variant, the light generator is a lamp contained within a light box mounted on the tap body; the light box having a window directed towards the tap handle and the tap handle has a transparent part and a root, said root being socketed in the handle holder such that said transparent part of the tap handle faces the light box window when the tap is closed; whereby, in use, the tap handle can radiate light until the tap is opened and tap handle transparent part no longer faces the light box window. Thus, an existing dispense tap may simply be modified by replacing the existing operating mechanism with a tap handle holder and a tap handle in accordance with this aspect of the present invention and attaching a light box to the tap body.

In a further variant, the tap handle is formed at least in part of light reflective material and the display apparatus includes means to direct light onto the exterior of the tap handle. Thus, in use, the tap handle will reflect light.

The above and other features of the present invention are illustrated, by way of example in the Drawings; wherein.

Figure 2:
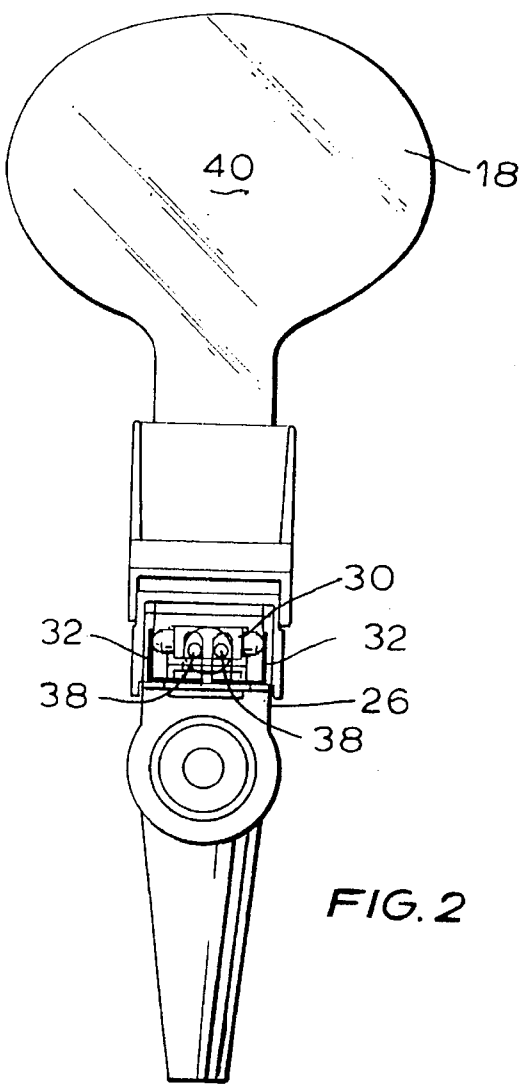
FIG. 2 is an end elevation of the tap of FIG. 1, viewed in the direction of arrow A.
Figure 1:
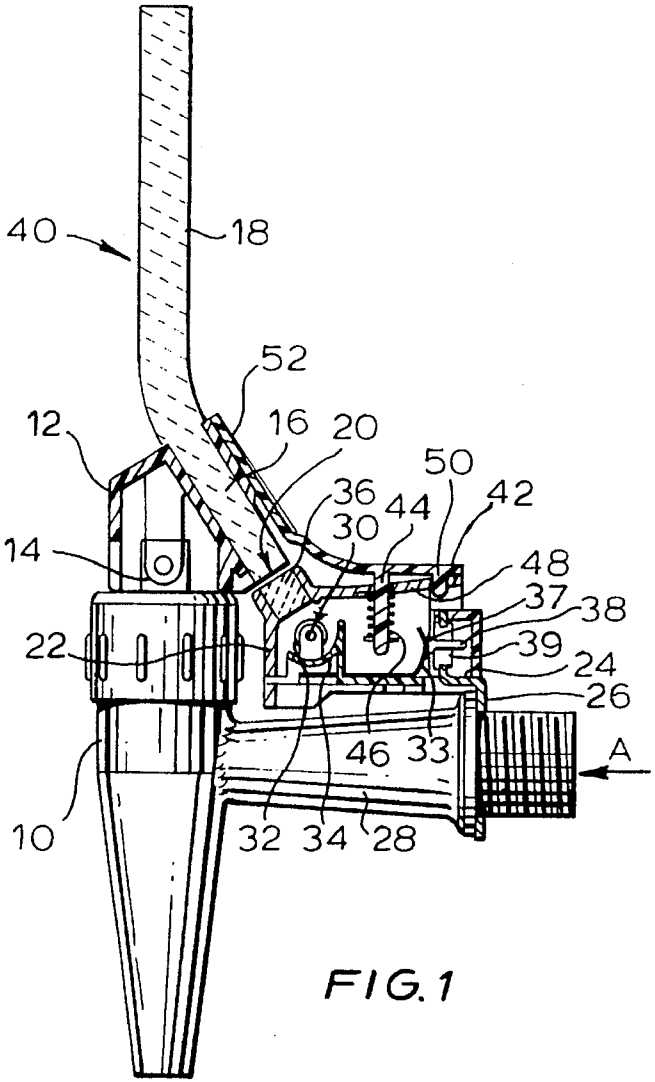
FIG. 1 is a part-sectioned side elevation of a dispense tap with an illuminated handle in accordance with said one embodiment of the present invention.

As shown by FIGS. 1 to 5, a conventional dispense tap 10, such as an ALUMASC (trade mark) type Q.A. tap, has its operating lever replaced by a handle holder 12 that is pivoted to the tap operating rod 14 to operate the tap in known manner. Socketed in the handle holder 12 is the root 16 of a handle 18, formed of a transparent plastics material; such as an acrylic. The root of the handle terminates in a planar face 20.

A light box 22, of moulded plastics material, is attached to the dispense tap by an L-shaped metal bracket 24, one arm of which is a sliding fit in the light box and the other arm 26 of which is apertured to fit over the threaded end of the tap shank 28 that screws into a counter fitting (not shown). The box itself overlies the tap shank and contains a festoon bulb 30 held between contact arms 32 over a reflector 34 that directs light from the bulb upwardly through a transparent window 36 onto the root face 20 of the tap handle 18. The contact arms and reflector act as heat shields and heat sinks, preventing beer in the tap shank from being over-heated. The contact arms are of springy, conductive material and extend back so that their ends 33 are biased against the heads 37 of a pair of contact pins 38 mounted in an insulating plug 39 in the bracket 24. A connector from a conventional 12 on 24 volt under-counter transformer (neither shown) connects to the contact pins 38. The light box is thus easily removed from the bracket, to enable the tap shank to be efficiently cleaned and to facilitate ease of light bulb replacement. The bracket thus carries fixed electrical contacts which allows the contact arm ends 33 to slide over the contact pin heads 37, permitting removal of the light box leaving the bracket and electrical connections behind.

Light from the bulb 30 is conveyed or directed into the handle 18, passing through the light box window 36 and the root face 20 to be totally internally reflected within the handle before it emerges (radiates) from the front face 40 of the handle.

The shape of the handle affects the amount and distribution of light within and hence radiation of light from the handle front face; i.e. its brightness. Devices, trade marks or any other form of customer information may be printed onto the back of the handle, whence it will appear as if front illuminated; or may be etched into the handle back face, whence the displayed customer information will appear to be self illuminated against a dark background. We have also discovered that the brightness and evenness of illumination of the handle may be improved by polishing the handle edges, or moulding them with a high finish. Still further improvement in illumination can be obtained by painting the handle edges white or attaching chrome tape or the like to increase internal reflectivity.

The light box 22 is also provided with a shutter 42, in the form of an L-shaped channel moulding, to prevent unwanted spillage of light from the box. The shutter is spring mounted, by an integral pin 44 having a surrounding biassing spring 46, to the top 48 of the light box, together with a further guide pin 50. The upper end 52 of the light shutter 42 overlies and masks the front of the handle holder 12 when the tap is closed position.

Figure 4:
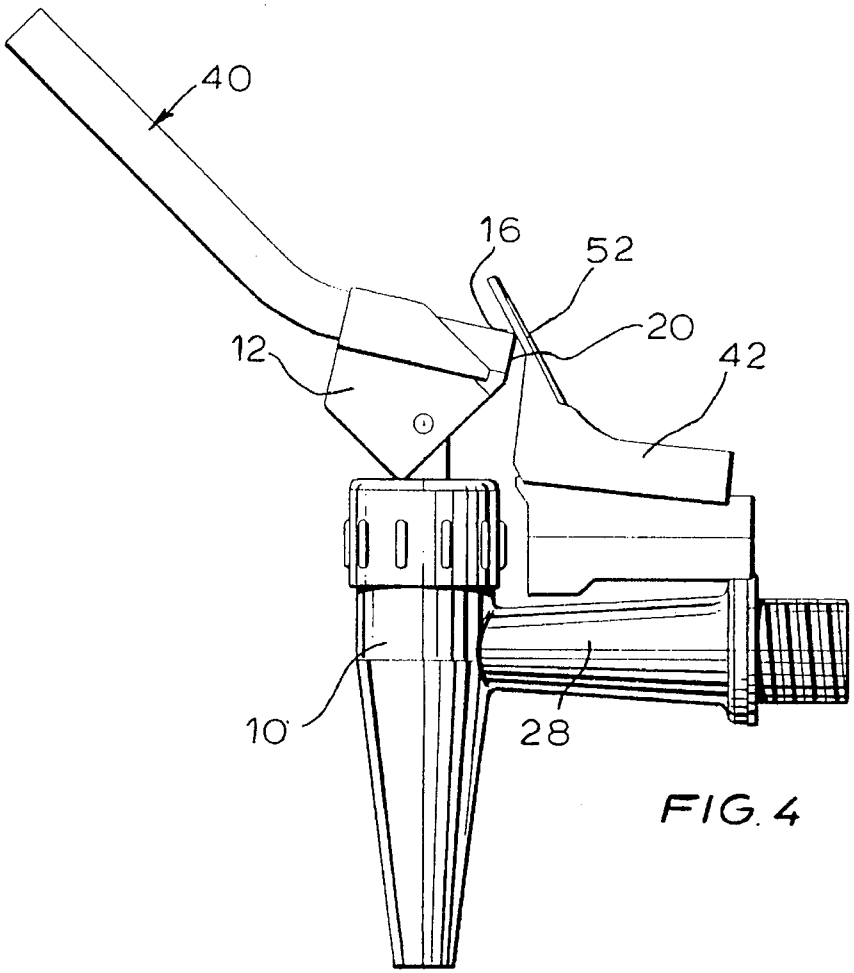
FIGS. 3 to 5 are side elevations of the tap of FIG. 1, in the closed, half-open and fully-open positions.
Figure 3:
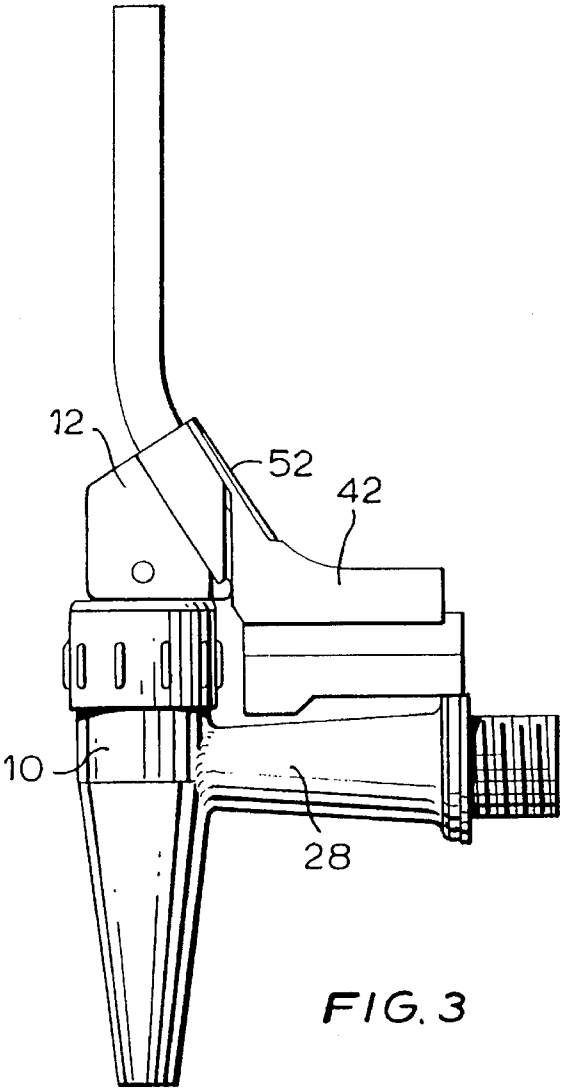
Figure 5:
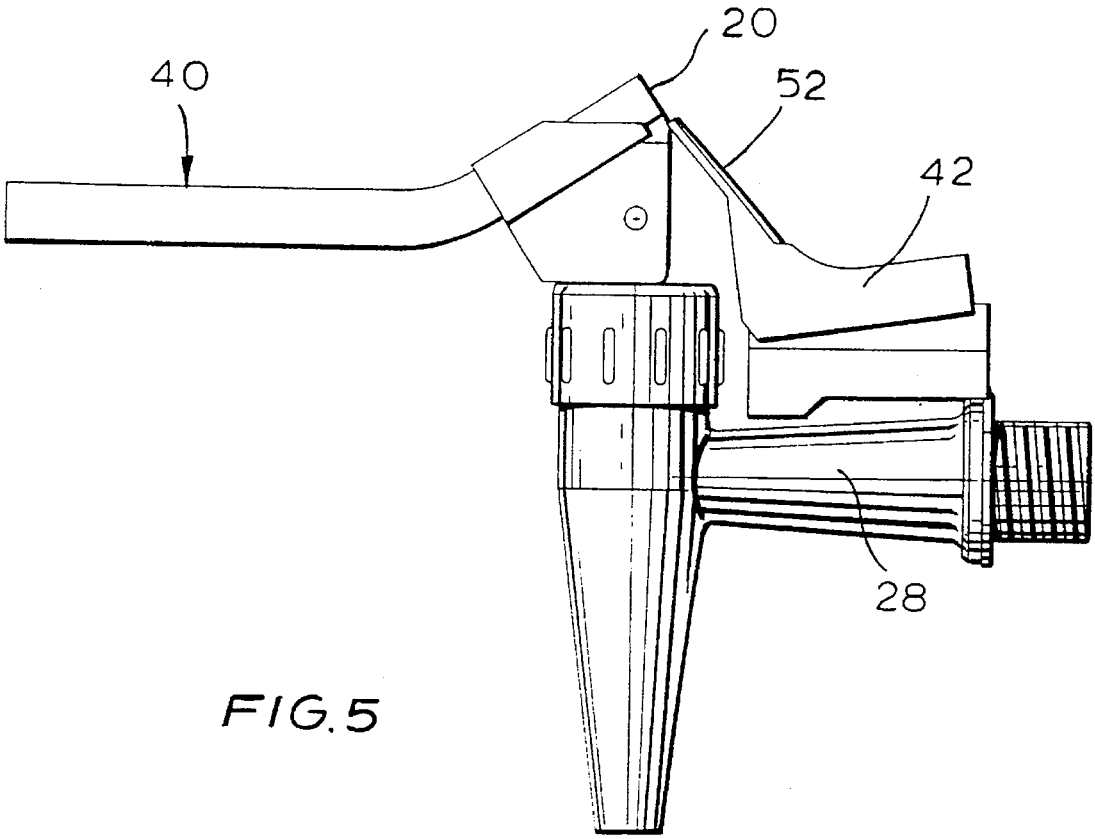

The action of the light shutter is best illustrated by reference to FIGS. 3 to 5. As previously mentioned, when closed (FIG. 3) the shutter 42 masks the handle holder 12; preventing light from bulb 30 spilling out forwardly, into the eyes of a customer, or rearwardly, into the eyes of an operator. When the tap is part-opened (FIG. 4) the handle root face 20 pivots upwardly and rearwardly against the inner surface of the shutter upper end 52, causing the shutter to rise upwardly and forwardly on pins 44 and 50. Light from the bulb 30 will no longer shine into the handle root 16, but shutter 42 will continue to shield the customer's eyes and the handle holder 12 will shield the operator's eyes. In the fully open position (FIG. 5) the shutter upper end 52 has ridden down the handle root face 20, permitting the shutter 42 to fall downwardly and rearwardly so that the shutter upper end now masks the light box window from the operator's eyes and the shutter as a whole continues to shield the customer's eyes. Closing the tap reverses this process, the handle holder first lifts the shutter upwardly and forwardly until the handle root face contacts the shutter and continues the upwards and forwards shutter motion until the contact between root and shutter goes "over centre" and the shutter moves downwardly and backwardly against the tap root as the tap handle moves to the fully closed position.

Thus the bulb 30 can be left on, even when the handle is being operated, this both ensures long bulb life and avoids the necessity for switch contacts.

In unillustrated variants of this embodiment of the present invention, the shutter may be replaced by a switch turning the bulb off as the handle is operated. Or, the light box may be incorporated in the handle holder; this enables the handle to remain illuminated whilst it is being operated.

Alternatively, the tap handle may be of or coated with a light reflective material and the counter fitting may include a spotlight directed to shine onto the handle.

Figure 7:
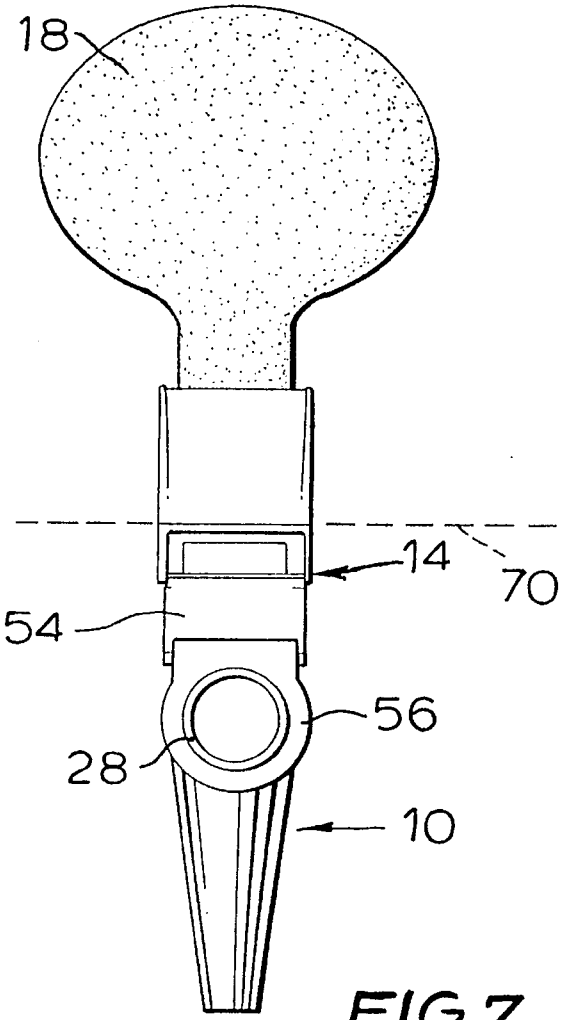
Figure 6:
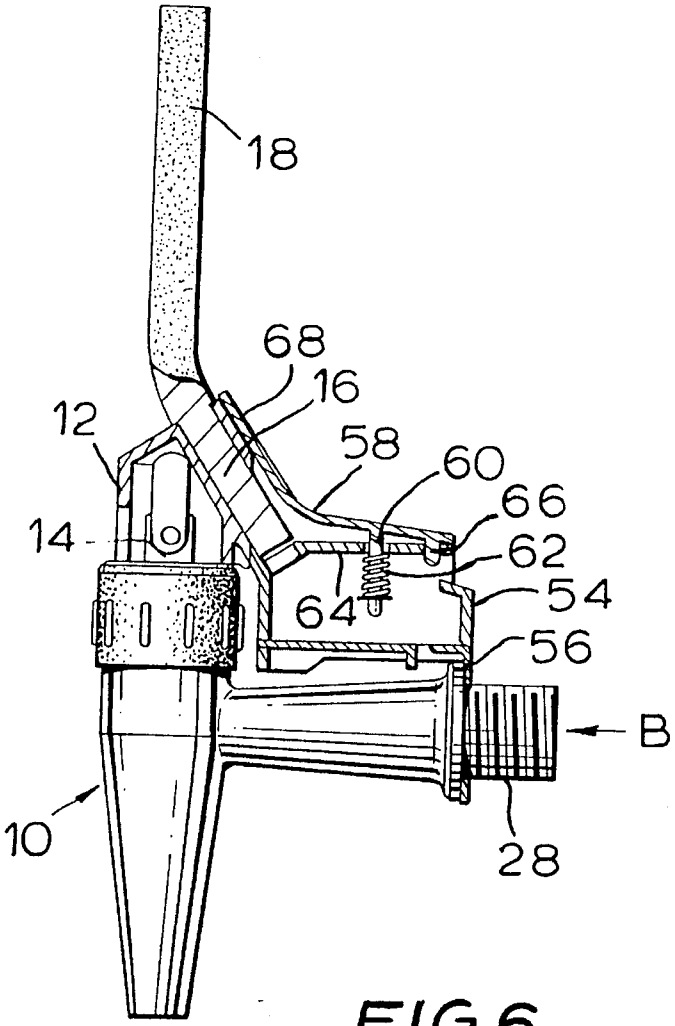
FIG. 6 is a part-sectioned side elevation of a dispense tap provided with a shield and a replaceable handle in accordance with said another embodiment of the present invention; and, FIG. 7 is an end elevation of the tap of FIG. 6, viewed in the direction of arrow B.

The light box and shutter also serve to hide or mask the pivotal attachment between the tap handle holder and the tap body, resulting in a visually attractive dispense tap even when the light is off. FIGS. 6 and 7 illustrate a simplified, non-illuminated display and shield also in accordance with the invention; like parts retain the same reference numerals.

A conventional dispense tap 10, such as an ALUMASC (trade mark) type Q.A. tap, has its operating lever replaced by a handle holder 12 pivoted to the tap operating rod 14 to operate the tap in known manner. Socketed in the handle holder 12 is the root 16 of a handle 18.

A box-shaped mounting 54, of moulded plastics material, is attached to the dispense tap by a metal bracket having an arm 56 apertured to fit over the threaded end of the tap shank 28 that screws into a counter fitting (not shown). The mounting box overlies the tap shank.

The mounting box 54 is also provided with a shield 58, in the form of an L-shaped channel moulding, the shield is spring loaded, by an integral pin 60 and surrounding biassing spring 62 that protrude through the top 64 of the mounting box. A further guide pin 66 is provided to maintain alignment of the shield relative to the mounting box. The upper end 68 of the shield 58 overlies and masks the front of the handle holder 12 when the tap is closed.

Mounting box 54 and shield 58 are effectively light box 22 and shutter 42 without the lamp and associated parts. The action of the shield is as described above with reference to FIGS. 3 to 5.

As best seen by FIG. 7, the customer's view of the dispense tap, the upper end 58 of the shield has a generally planar outer surface that appears above the counter top (indicated by chain line 70). This shield upper end faces the customer irrespective of the operational position of the tap handle and is intended for use for display of the beer being dispensed or any other form of customer information.

The shielding of the pivot 14 and, in the example, the handle holder 12 presents a neat and pleasing appearance for the dispense tap. The tap handle can readily be changed so as to alter the appearance of the tap; this is most important as many beers, lagers etc. have a distinctive "get-up" and the present invention obviates the need for a distinctive counter mount.

Existing dispense taps can readily be adapted to the present invention, the tap handle holder replacing the old tap handle and the mounting box being fitted to the tap shank.

In addition, the shield acts to prevent foreign objects, such as tea towels, cigarette ends, matches etc., from being trapped between the leading edge of the handle holder and the tap body and preventing the tap from fully closing.

Clearly, a removable tap handle is not an essential feature of either embodiment of the present invention.

The present invention has been described when applied to a beer dispense tap wherein the tap handle has a pivotal/camming action that lifts the tap operating rod to open a diaphragm valve contained in a tap body below the tap handle. However, the present invention is equally applicable to other types of dispense tap; side action rotary, top action lever, etc. In such applications it may or may not be necessary to turn the lamp on or off, to shutter illumination of the tap handle by the lamp or to mask the operating interface between tap handle and tap body from customer view.

We claim:

1. In combination customer information display apparatus and a dispense tap, for beverages and other fluids, and having a tap body, for attachment to a counter fitting, and an operating lever assembly with an illuminated tap handle, connected to a tap opening and closing mechanism in the tap body, wherein:

the operating lever assembly includes a tap handle formed at least in part of light transparent and/or light reflective material and a tap handle holder connected to the tap opening and closing mechanism; and the display apparatus includes a light generator mounted externally to the tap handle, and means to direct light from the light generator into or onto the tap handle;

whereby, in use, the tap handle can be illuminated to display customer information.

2. The combination of claim 1, wherein the tap handle is formed at least in part of light transparent material and the light director means are arranged to direct light from the light generator into the interior of the tap handle.

3. The combination of claim 1, wherein the light generator is mounted on an element selected from the group of elements consisting of the tap handle holder, the tap body and the counter fitting.

4. The combination of claim 3, wherein the light generator is a lamp contained within a light, box mounted on the tap body; the light box having a window directed towards the tap handle.

5. The combination of claim 4, wherein the tap handle has a transparent part and a root, said root being socketed in the handle holder such that said transparent part of the tap handle faces the light box window when the tap is closed; whereby, in use, the tap handle can radiate light until the tap is opened and the transparent part of the tap handle no longer faces the light box window.

6. The combination of claim 5, wherein the tap handle root terminates in a planar face and the handle holder and light box are arranged so that the light box window faces the tap handle root face when the tap is closed.

7. The combination of claim 6, wherein a shield is provided to prevent spillage of light from the light generator when the tap is closed or open.

8. The combination of claim 7, wherein the shield comprises a shutter movably attached to the lightbox by a mechanism operative, in use, to bias the shield against the handle holder to mask from customer view the interface between the light box window and the tap handle root planar face when the tap is closed and to cover the light box window when the tap is open.

9. The combination of claim 4, wherein a switch is provided to turn the light generator off when the tap is open.

10. The combination of claim 2, wherein the tap handle has a root which is socketed in the handle holder and the light generator is contained within the tap handle holder; whereby, in use, light can be directed into the tap handle root irrespective of the operational position of the tap handle and holder.

11. The combination of claim 1, wherein the tap handle is formed at least in part of light reflective material and the display apparatus includes means to direct light from the light generator onto the tap handle.

12. The combination of claim 1, wherein the tap hand is formed at least in part of light reflective material and the display apparatus is a spot light carried by the counter fitting and directed to shine onto the tap handle.

* * * * *